United States Patent [19]

Smith

[11] 4,071,435

[45] Jan. 31, 1978

[54] DENITROGENATION OF SYNCRUDE

[75] Inventor: Robert H. Smith, Plano, Tex.

[73] Assignee: Atlantic Richfield Company, Los Angeles, Calif.

[21] Appl. No.: 803,832

[22] Filed: June 6, 1977

[51] Int. Cl.[2] ..... C10G 25/00; C10G 13/02

[52] U.S. Cl. ..... 208/91; 208/254 R

[58] Field of Search ..... 208/254 R, 85, 91, 88

[56] References Cited

U.S. PATENT DOCUMENTS

| | | | |
|---|---|---|---|
| 2,291,886 | 8/1942 | Egloff | 208/88 |
| 2,796,387 | 6/1957 | Schmidt | 208/254 R |
| 2,970,105 | 1/1961 | Condo, Jr. et al. | 208/254 R |
| 3,189,539 | 6/1965 | Sieg | 208/254 R |
| 3,193,496 | 7/1965 | Hartung | 208/254 R |
| 3,223,618 | 12/1965 | Convery et al. | 208/88 |

FOREIGN PATENT DOCUMENTS

| | | | |
|---|---|---|---|
| 332,336 | 7/1930 | United Kingdom | 208/91 |

*Primary Examiner*—George Crasanakis
*Attorney, Agent, or Firm*—Roderick W. MacDonald

[57] ABSTRACT

A method for reducing the nitrogen content of a syncrude feed obtained from at least one of oil shale, tar sands, and coal wherein the syncrude is mixed with an extractant-catalyst which is effective for extracting nitrogen materials from the syncrude feed and also effective as a hydrocracking catalyst for said syncrude feed. Said mixing helps form a first phase composed of a first low nitrogen syncrude product and a second phase composed of said extractant-catalyst and high nitrogen syncrude feed, separating said first and second phases from one another, and hydrocracking said second phase to produce a second low nitrogen syncrude product.

6 Claims, 2 Drawing Figures

DENITROGENATION OF SYNCRUDE

BACKGROUND OF THE INVENTION

Hydrocarbonaceous liquids obtained from tar sands, coal, and oil shale generally contain relatively high quantities of nitrogen in various forms, generally five and six member cyclic compounds such as pyridines and indoles. It is desirable in a number of cases to reduce the nitrogen content of such syncrude materials, particularly if they are to be used as fuel.

SUMMARY OF THE INVENTION

According to this invention syncrude feed containing nitrogen is mixed with at least one material which is effective both to extract nitrogen compounds from the syncrude feed and to serve as a hydrocracking catalyst for said syncrude feed, the mixing of said extractant-catalyst with the feed to help form two phases, a first phase composed essentially of a first low nitrogen syncrude product and a second phase composed essentially of the extractant-catalyst and high nitrogen syncrude feed. The second phase is subjected to hydrocracking conditions which produce a second low nitrogen syncrude product.

Accordingly, it is an object of this invention to provide a new and improved method for processing syncrude materials. It is another object to provide a new and improved method for denitrogenation of syncrude feed.

Other aspects, objects and advantages of this invention will be apparent to those skilled in the art from this disclosure and the appended claims.

DETAILED DESCRIPTION OF THE INVENTION

Figure 1:
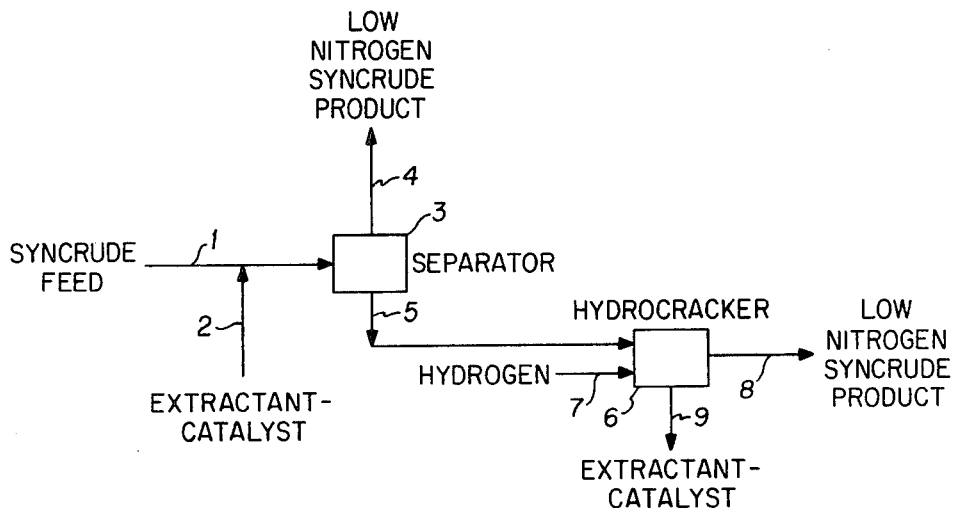
FIG. 1 shows a process embodiment within this invention wherein the syncrude feed is first mixed with extractant-catalyst whereafter a separation step is carried out. The extractant-catalyst and high nitrogen syncrude mixture is separated out, and then subjected to hydrocracking to form additional low nitrogen syncrude product.

FIG. 1 shows syncrude feed in pipe 1 which feed is at least one hydrocarbonaceous liquid (full range or one or more cuts thereof) obtained from tar sands, normally solid coal, and/or oil shale, i.e., syncrude. This feed contains an amount of nitrogen that is to be reduced. Depending upon the desired use of the syncrude product, the syncrude feedstream can contain widely varying amounts of nitrogen, e.g., from about 10 ppm to about 10 weight percent. That is to say that the initial quantity of nitrogen in the syncrude feed can be any amount, including that which initially appears to be quite low. However, whatever the initial amount of nitrogen is, for widely varying reasons, the amount, no matter how low, is desirably reduced for some sort of ultimate reason.

The feed in pipe 1 is mixed with an extractant-catalyst by way of pipe 2 and the mixture then passes into separator 3. A mixing chamber can be employed if desired.

The extractant-catalyst is employed in the feed in pipe 1 in an amount effective to serve both to extract nitrogen compounds and later to serve as a catalyst for the feed present in the hydrocracker. The extractant-catalyst can be any material which serves the above double requirement, and, preferably, is selected from the group consisting of halides (chlorine, fluorine, bromine and iodine) of zinc, cadmium, mercury, lead, and copper. Of course, mixtures of two or more of such halides can be employed in this invention. The extractant-catalyst is generally employed in an amount of at least about 5 weight percent based on the total weight of the syncrude feed to which it is added, the maximum amount of extractant-catalyst employed being dictated only by economics and not by operability of the process.

The syncrude feed and extractant-catalyst are mixed at ambient conditions of temperature and pressure and for a time sufficient to allow formation of said two phases, the first phase being essentially a low nitrogen syncrude product and the second phase being essentially a mixture of extractant-catalyst and high nitrogen syncrude. The low nitrogen syncrude product generally contains at least 20% lower nitrogen concentration than the high nitrogen feed in the second phase.

The first phase is removed from the separator by way of pipe 4 while the second phase is separately removed from the separator by way of pipe 5 and passed to hydrocracker 6.

In hydrocracker 6 the mixture of extractant-catalyst and high nitrogen syncrude is subjected to hydrocracking conditions of from about 650° to about 1000° F in the presence of molecular hydrogen added by way of pipe 7 and autogenous pressure. The residence time is sufficient to crack the hydrocarbonaceous materials present and form a low nitrogen syncrude product which also has a nitrogen content at least 20 weight percent lower than that of the high nitrogen syncrude material in pipe 5. This additional low nitrogen syncrude product formed in hydrocracker 6 is removed by way of pipe 8 for use as desired, including, but not limited to, combination with the product in pipe 4.

Extractant-catalyst is separately removed from hydrocracker 6 by way of pipe 9.

Figure 2:
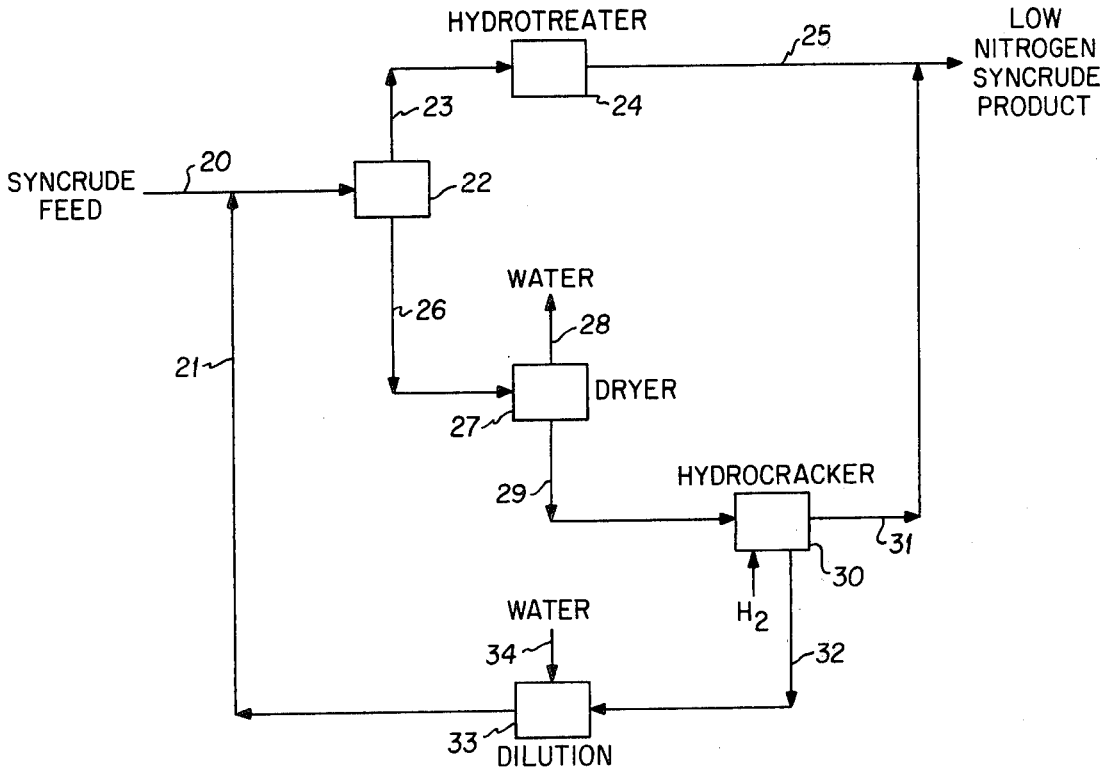
FIG. 2 shows another embodiment within this invention similar to the process of FIG. 1 except that FIG. 2 shows an intermediate drying step between separation and hydrocracking, and the recovery of extractant-catalyst for reuse in the process.

FIG. 2 shows syncrude feed in pipe 20 being mixed with extractant-catalyst from pipe 21 and then passing into separator 22.

From separator 22 there is recovered by way of pipe 23 a low nitrogen syncrude product which, optionally, can be subjected to additional light or mild hydrotreating in hydrotreater 24 to further reduce the nitrogen content of that material. The low nitrogen syncrude product obtained from hydrotreater 24 by way of pipe 25 is a product of the process.

The mixture of extractant-catalyst and high nitrogen syncrude removed from separator 22 by way of pipe 26 is passed to dryer 27 wherein water is removed and separated by way of pipe 28. The dried mixture of extractant-catalyst and high nitrogen syncrude is then passed by way of pipe 29 to hydrocracker 30 wherein the syncrude is subjected to the aforesaid hydrocracking conditions in the presence of hydrogen to form a low nitrogen syncrude product which is recovered by way of pipe 31 and combined with the product in pipe 25 to form the final product of the process.

Extractant-catalyst is recovered from the hydrocracker by way of pipe 32 and passed to dilution means 33 wherein water is added by way of pipe 34 to reconstitute it to an aqueous solution suitable for mixing with fresh syncrude feed in pipe 20.

Hydrocracking is well known in the art and any conventional hydrocracking process is applicable to this invention, the same applying to hydrotreating, e.g., that disclosed in U.S. Pat. No. 4,003,829, the disclosure of which is incorporated herein by reference. As regards hydrotreating unit 24, only light hydrotreating is necessary, i.e., low temperature, high space velocity, and the like, since the product in pipe 23 is already a low nitrogen material. All of the details and requirements necessary for the above described hydrotreating and hydrocracking steps will be readily known to one skilled in the art.

EXAMPLE

A process was carried out similar to that shown in FIG. 1 wherein a shale oil feed formed from Colorado oil shale which contained 2.17 weight percent nitrogen was mixed with an aqueous solution of zinc chloride which contained 33 weight percent zinc chloride. Equal weights of said zinc chloride solution and said syncrude feed were mixed at 100° F and atmospheric pressure for 15 minutes after which the mixture was passed to a separator and allowed to set for 30 minutes at essentially quiescent conditions and ambient conditions of temperature and pressure until, due to density variations, two phases formed. One phase was a low nitrogen syncrude phase containing 1.59 weight percent nitrogen and essentially no zinc chloride. The second phase contained essentially all of the zinc chloride and a high nitrogen syncrude phase containing 8.0 weight percent nitrogen. The low nitrogen syncrude phase was removed from the separator and from the process as a final product.

The zinc chloride-high nitrogen syncrude phase mixture is separately subjected to hydrocracking conditions of 800° F, 2500 psig, and a volumetric hourly space velocity of 1.0 volumes feed oil per volume of reactor per hour and in the presence of molecular hydrogen. During this hydrocracking step and high nitrogen syncrude is cracked and denitrogenated to form a low nitrogen syncrude product containing at least 20 weight percent nitrogen less than the high nitrogen syncrude feed to the hydrocracker.

Reasonable variations and modifications are possible within the scope of this disclosure without departing from the spirit and scope of this invention.

The embodiments of the invention in which an exclusive property or privilege is claimed are defined as follows:

1. A method for reducing the nitrogen content of a syncrude feed obtained from at least one of oil shale, tar sands, and coal, comprising a. mixing an extractant-catalyst with said feed, said extractant-catalyst being effective for extracting, nitrogen materials from said syncrude feed and also for serving as a hydrocracking catalyst for said syncrude feed, b. settling the mixture from step (a) into a first phase composed essentially of a first low nitrogen syncrude product, and a second phase composed essentially of said extractant-catalyst and high nitrogen-containing syncrude liquid, c. separating said first and second phases from one another, and d. hydrocracking said second phase to produce a second low nitrogen syncrude product.

2. The method according to claim 1 wherein said extractant-catalyst is selected from the group consisting of halides of zinc, cadmium, mercury, lead, copper, and mixtures thereof.

3. The method according to claim 2 wherein said extractant-catalyst is employed in an amount of at least 5 weight percent based on the total weight of said syncrude feed.

4. The method according to claim 1 wherein said hydrocracking is carried out in the presence of molecular hydrogen at a temperature of from about 650° to about 1000° F.

5. The method according to claim 1 wherein said second phase is subjected to drying conditions to remove water prior to hydrocracking step (d), said extractant-catalyst is recovered from said hydrocracking step, and said recovered extractant-catalyst is diluted with water for reuse in step (a).

6. The method according to claim 1 wherein said extractant-catalyst is zinc chloride.

* * * * *